United States Patent [19]

Morrell

[11] 4,136,300

[45] Jan. 23, 1979

[54] CATHODE RAY TUBE HAVING IMPROVED SHADOW MASK

[75] Inventor: Albert M. Morrell, Lancaster, Pa.

[73] Assignee: RCA Corporation, New York, N.Y.

[21] Appl. No.: 729,592

[22] Filed: Oct. 4, 1976

Related U.S. Application Data

[63] Continuation-in-part of Ser. No. 559,778, Mar. 19, 1975, abandoned.

[51] Int. Cl.[2] ..... H01J 29/07

[52] U.S. Cl. ..... 313/403

[58] Field of Search ..... 313/402, 403, 408

[56] References Cited

U.S. PATENT DOCUMENTS

| | | | |
|---|---|---|---|
| 2,745,978 | 5/1956 | Van Ormer | 313/408 |
| 2,937,297 | 5/1960 | Burdick | 313/402 |
| 2,947,899 | 8/1960 | Kaplan | 313/408 |
| 3,109,117 | 10/1963 | Kaplan | 313/408 |
| 3,226,229 | 12/1965 | Kaplan | 313/408 X |
| 3,282,691 | 11/1966 | Morrell et al. | 96/36.1 |
| 3,435,268 | 3/1969 | Rublack | 313/408 |
| 3,590,303 | 6/1971 | Coleclough | 313/408 |
| 3,721,853 | 3/1973 | Naruse et al. | 313/402 |
| 3,889,145 | 6/1975 | Suzuki et al. | 313/408 |
| 3,944,867 | 3/1976 | Kaplan | 313/403 |

FOREIGN PATENT DOCUMENTS

| | | |
|---|---|---|
| 867002 | 5/1961 | United Kingdom. |
| 1012729 | 12/1965 | United Kingdom. |
| 1014905 | 12/1965 | United Kingdom. |
| 1165766 | 10/1969 | United Kingdom. |
| 1249954 | 10/1971 | United Kingdom. |

*Primary Examiner*—Robert Segall

*Attorney, Agent, or Firm*—Eugene M. Whitacre; Glenn H. Bruestle; Dennis H. Irlbeck

[57] ABSTRACT

A cathode-ray tube of the vertical line screen, slit apertures mask type includes a mask wherein the horizontal curvature of the mask is made greater than that suggested by the prior art for similar type tubes. Because of the added curvature, the degree of electron beam misregister caused by mask doming is reduced. To obtain acceptable packing of the screen lines, the horizontal center-to-center spacing between adjacent apertures in the mask are varied in relation to the difference in mask-to-screen spacing with respect to the prior art. The additional mask curvature need not necessarily be in a single arch but also may take the form of parallel extending corrugations in the mask.

12 Claims, 36 Drawing Figures

PRIOR ART
Fig. 8
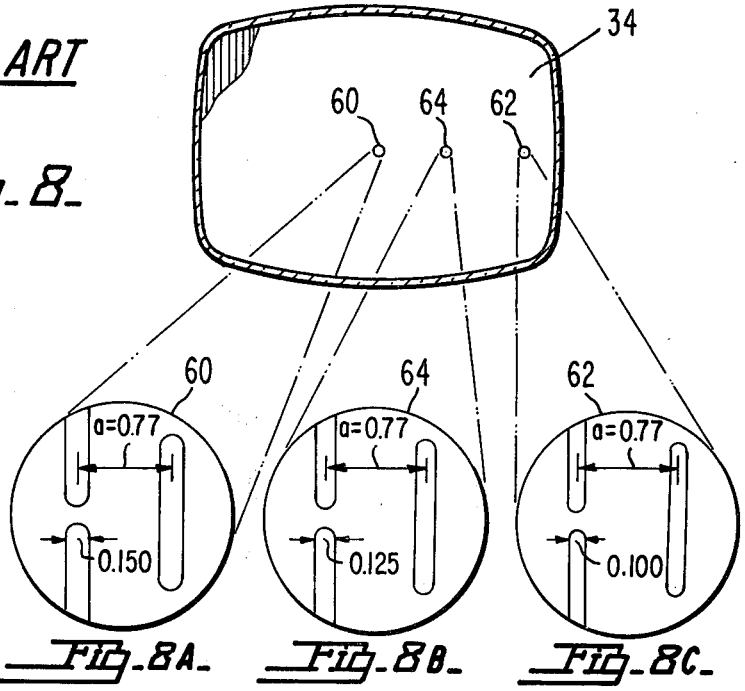
Fig. 8A Fig. 8B Fig. 8C
Fig. 9
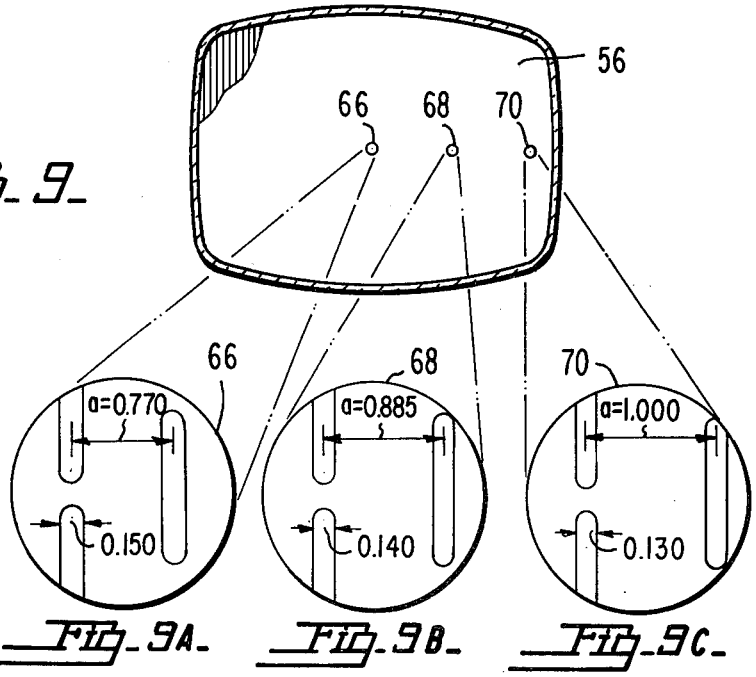
Fig. 9A Fig. 9B Fig. 9C

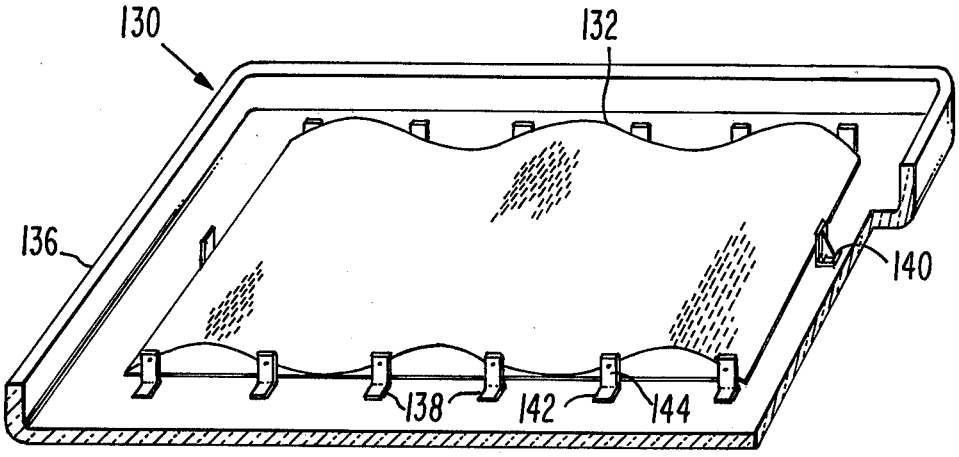
Fig. 24.
Fig. 26.
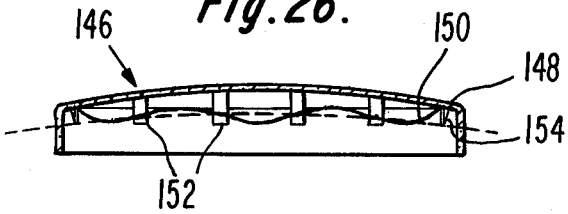
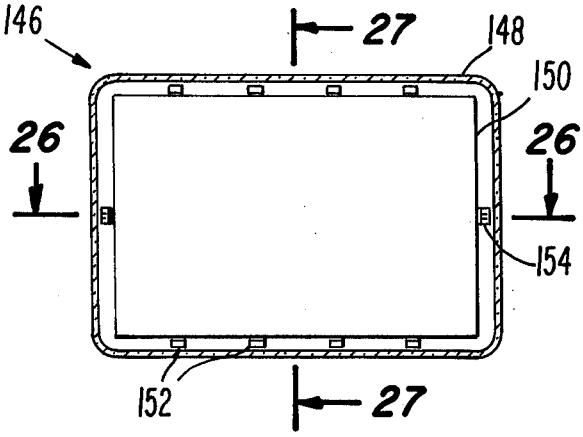
Fig. 25.
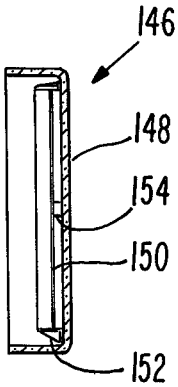
Fig. 27.

CATHODE RAY TUBE HAVING IMPROVED SHADOW MASK

This is a continuation-in-part of application Ser. No. 559,778, filed on Mar. 19, 1975 and now abandoned.

BACKGROUND OF THE INVENTION

This invention relates to cathode-ray tubes having apertured shadow masks therein, and particularly to a shadow mask construction which reduces misregister between electron beams and phosphor elements of the tube screen caused by expansion of the shadow mask and which also facilitates construction of a flat faceplate cathode-ray tube.

In a shadow mask type cathode-ray tube for producing a color image, a plurality of convergent electron beams are projected through a multi-apertured color selection shadow mask to a mosaic screen. The beam paths through the mask are such that each beam impinges upon and excites only one kind of color-emitting phosphor on the screen. Generally, the shadow mask is attached to a rigid frame, which in turn, is suspended within the picture tube envelope.

When a color cathode-ray tube is operated, the electrons that strike the shadow mask cause it to heat up. Since the edges of the shadow mask are attached to a somewhat heavy frame which serves as a heat sink, a temperature differential developes between the center and peripheral portions of the mask. Because of the temperature differentials, the mask center, the mask edge and the frame expand at different rates. This difference in expansion rates causes a doming of certain portions of the mask toward the screen. In the center of the screen, doming causes little effect on the register between the electron beams and phosphor elements because the straight line projection of the beams to the elements remains unchanged with changes in mask to screen spacing. Since the edges of the mask are fixed to a peripheral frame, there is no doming at the mask edges. Therefore, maximum misregister caused by doming occurs approximately halfway between the mask center and mask edge. Misregister is defined as being the amount an electron beam is off-center from its respective phosphor element. Because of this doming, the electron beams passing through the mask misregister with the phosphor elements of the screen. The misregister effect of doming peaks after 3 to 5 minutes of tube operation but continues to have a diminishing effect on tube performance for an additional 10 to 15 minutes. Once the tube has reached steady state temperatures, general electron beam misregister caused by expansion of the mask is compensated by temperature sensitive frame supports which move the mask-frame assembly toward the screen. Such temperature compensating support is disclosed in U.S. Pat. No. 3,803,436 issued to me on Apr. 9, 1974.

Another problem somewhat related to doming is blister warpage. Blistering occurs during operation of the tube and is caused by a video pattern, such as a sustained white spot in the TV image, that developes localized heating of a part of the mask.

SUMMARY OF THE INVENTION

A cathode-ray tube of the apertured mask type includes a mask wherein the curvature of at least a portion of the mask is greater than the curvature of a mask of a tube suggested by the prior art. The invention reduces doming and blistering and thereby also reduces electron beam misregister caused by these problems. Furthermore, the invention allows for design of a practical tube having a flat faceplate.

BRIEF DESCRIPTION OF THE DRAWINGS

FIG. 8 is a rear view, partly cutaway, of a tube faceplate having a prior art shadow mask mounted therein.

FIGS. 8A, 8B and 8C are enlarged views of indicated portions of the mask of FIG. 8.

FIG. 9 is a rear view, partly cutaway, of a tube faceplate having a shadow mask mounted therein that incorporates one embodiment of the present invention.

FIGS. 9A, 9B and 9C are enlarged views of indicated portions of the mask of FIG. 9.

FIG. 24 is a perspective view of a cathode-ray tube mask-faceplate assembly incorporating a corrugated mask.

FIG. 25 is a rear view of a cathode-ray tube mask-faceplate assembly having cylindrical faceplate and a cylindrically-shaped corrugated mask.

FIGS. 26 and 27 are axial section views taken, respectively, at lines 26—26 and 27—27 in FIG. 25.

DETAILED DESCRIPTION OF THE PREFERRED EMBODIMENT

Figure 1:
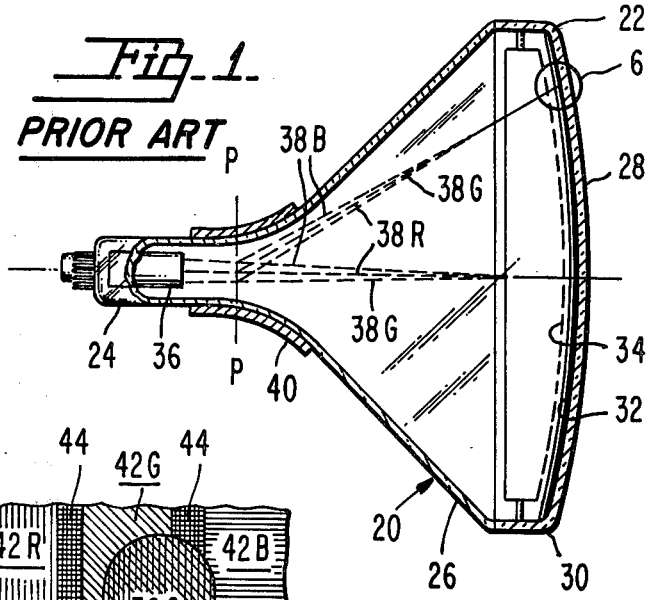
Fig. 1. PRIOR ART
FIG. 1 is a plan view, partly in axial section of a prior art shadow mask cathode-ray tube.

FIG. 1 illustrates a prior art rectangular color picture tube, having an evacuated glass envelope 20 comprising a rectangular panel or cap 22 and a tubular neck 24 connected by a funnel 26. The panel 22 comprises a viewing faceplate 28 and a peripheral flange or sidewall 30 which is sealed to the funnel 26. A mosaic three-color phosphor screen 32 is located on the inner surface of the faceplate 28. The screen 32 is a line screen, i.e., comprised of an array of parallel phosphor lines or strips, with the phosphor lines extending substantially parallel to the vertical axis of the tube, i.e., perpendicular to the high frequency scan direction. The area between phosphor lines is filled with a light absorbing material. A multiapertured color selection electrode or shadow mask 34 is removably mounted in predetermined spaced relationship to the screen 32. An inline electron gun 36, shown schematically in FIG. 1, is mounted within the neck 24 to generate and direct three electron beams 38B, 38R and 38G along co-planar convergent paths through the mask 34 to the screen 32.

The tube of FIG. 1 is designed to be used with an external magnetic deflection yoke 40, surrounding the neck 24 and funnel 26, in the vicinity of their junction. When appropriate voltages are applied to the yoke 40, the three beams 38B, 38R and 38G are subjected to vertical and horizontal magnetic fields that cause the beams to scan horizontally and vertically in a rectangular raster over the screen 32.

For simplicity, the actual curvature of the paths of the deflected beams in the deflection zone is not shown in FIG. 1. Instead, the beams are schematically shown as having an instantaneous bend at the plane of deflection P—P.

Although the present invention is described herein with respect to an inline gun, line-screen type cathode-ray tube, it should be appreciated that the broader concept of the invention is also applicable to the delta gun, dot-screen cathode-ray tube as well as to other cathode-ray tube types.

Figure 2:
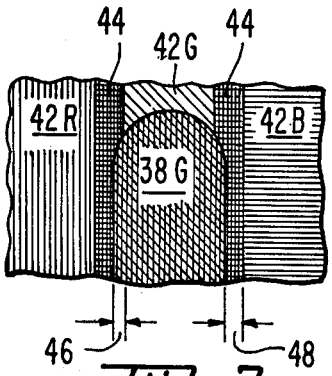
FIGS. 2, 3 and 4 are enlarged schematic views of portions of a line screen showing an electron beam impinging thereon.
Figure 3:
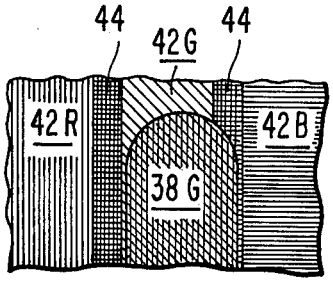
Figure 4:
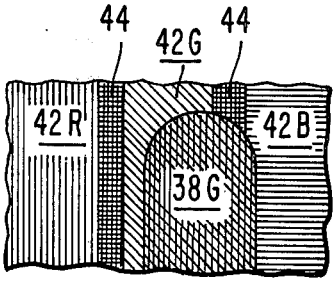

For a full understanding of the present invention, it is desirable to know what electron beam misregister is. FIGS. 2, 3 and 4 show the electron beam 38G impinging on a portion of the screen 32. Each phosphor line (42R, 42G and 42B) is separated from its adjacent line by a gap that is filled in with a light absorbing substance 44. The width of the beam 38G is slightly wider than its associated phosphor line 42G. This arrangement is commonly referred to as a negative tolerance matrix and is a preferred screen construction for practicing the present invention. The present invention also is equally applicable to positive tolerance matrix tubes (phosphor lines which are separated by a light absorbing substance and which are wider than their associated beams) and to non-matrix tubes. In FIG. 2, the electron beam 38G is exactly centered on its associated phosphor line 42G. This is the desired beam position for accurate color output. In this position, the beam must move a distance 46 before excitation of the line 42G diminishes. This distance 46 is the leaving tolerance at the specific location on the screen. The distance 48 that the beam must move before it touches an adjacent line 42B is the clipping tolerance of the tube at that location. As the tube begins to warm up, doming of the shadow mask will occur moving the center of the mask toward the screen and the beam 38G will begin to misregister with its associated phosphor line 42G as in FIG. 3. In this case, the green phosphor line does not receive full excitation and the green color output falls off in intensity. FIG. 4 shows a more extreme case where the electron beam 38G has become misregistered to the extent that it is impinging on an adjacent phosphor line 42B, thus causing a color purity problem.

Figure 5:
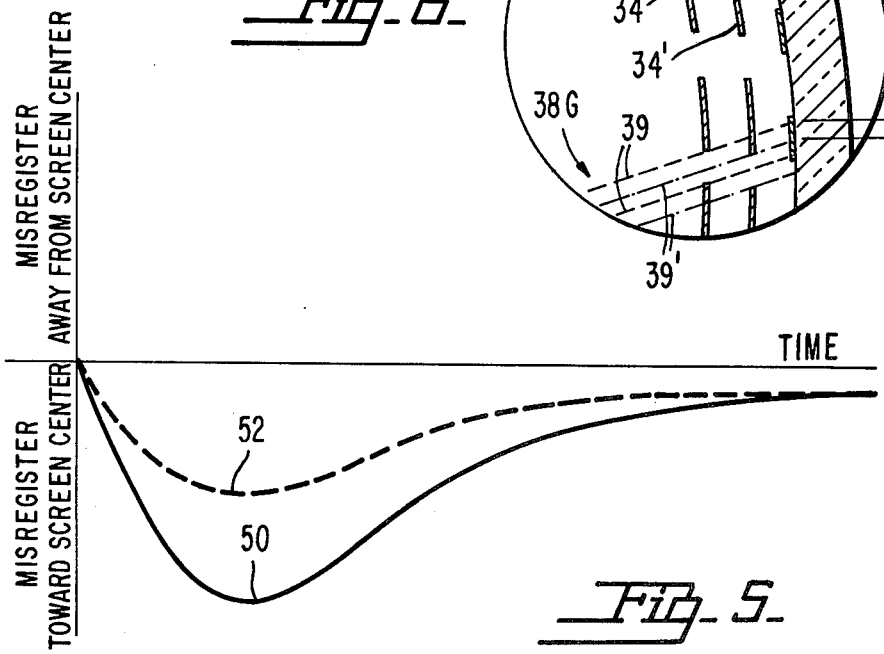
FIG. 5 is a graph of electron beam misregister at a point halfway between the center and edge of a shadow mask versus time.

As previously noted, the doming effect is caused by uneven temperature of the shadow mask assembly. FIG. 5 presents a graph of misregister as a function of time of an electron beam with a corresponding phosphor line located halfway between the center and edge of the screen. The solid curve 50 represents misregister for a prior art tube and the dashed curve 52 represents the misregister in a tube using one embodiment of the present invention. The peaks of the curves 50 and 52 occur from 3 to 5 minutes after tube activation. The misregister then decreases as the mask continues to warm up.

Figure 6:
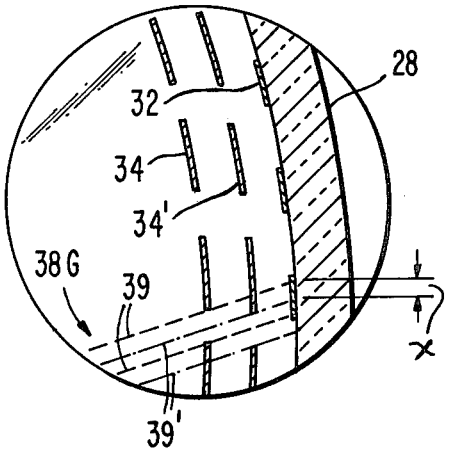
FIG. 6 is an enlarged view of a portion of the mask and screen in the area indicated by the numeral 6 in FIG. 1.

It should be noted that doming is a movement of a portion of the mask toward the screen while the periphery of the mask is held stationary. The effect of this movement is illustrated in FIG. 6. The shadow mask is indicated in two positions, its unheated, undomed position, designated 34 and its heated, domed position, designated 34'. The boundaries of a portion of a beam 38G that passes through an aperture of the unheated mask 34 are shown by dashed lines 39 and the boundaries of the beam portion that passes through the same aperture of the domed mask 34' are indicated by the dot and dash lines 39'. The distance "x" indicated in FIG. 6, represents misregister occuring because of doming. The result of doming misregister is a shift of beam landing position on the screen toward the center of the screen 32.

As the mask warms up, the effect of doming decreases because the temperature gradients in the mask decrease. Furthermore, heating of the mask and frame causes the mask to expand thereby moving the apertures in the mask laterally outwardly (i.e., parallel to the screen) from their original locations. Such outward movement produces a misregister away from the center of the screen. It is then this combination of doming reduction and heating of the mask and frame that causes the mask apertures to return toward alignment with the associated phosphor lines. However, the expansion of the mask causes more severe misregister problems at the edge of the screen. In order to correct for the misregister problem at the edge of the screen, it is common to support the mask-frame assembly on heat sensitive supports that move the mask-frame assembly toward the screen to reduce or eliminate the misregister caused by mask expansion. Since the compensation provided is correct only when there is no heat gradient between the portions of the mask in the support frame, some residual misregister at the halfway point as shown by the curves of FIG. 5 will exist. It also should be noted that because the mask has a greater heat sink at its edge, i.e., mask frame, some temperature transient will always exist in the mask during tube operation, and therefore some degree of doming will always be present.

Figure 7:
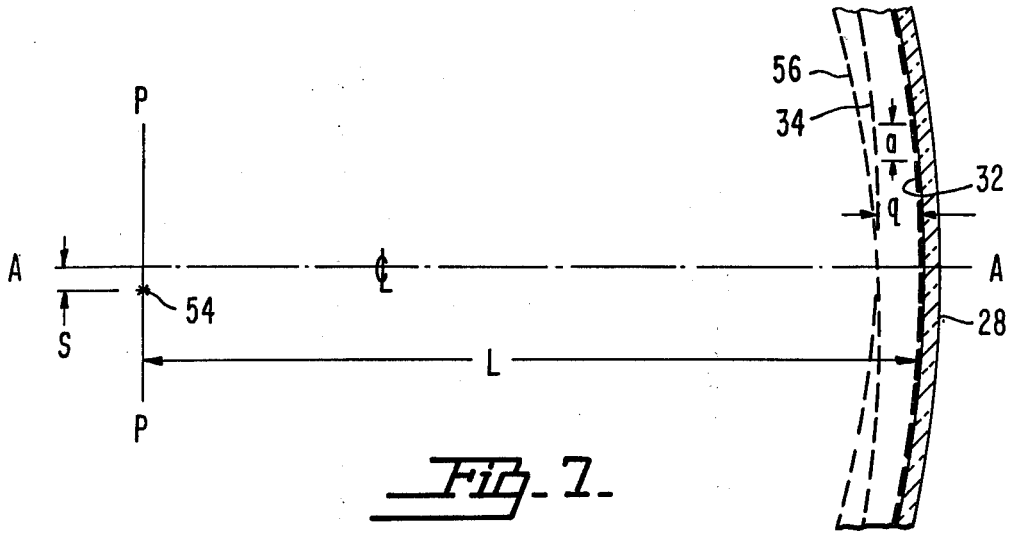
FIG. 7 is a schematic side view illustrating geometric relationships between an electron beam, a mask and a screen.

FIG. 7 illustrates the geometry of a shadow mask tube. Line P—P again represents the plane of defleciton (at zero deflection) as in FIG. 1. The distance from the plane P—P to the screen 32 is designated "L" and the spacing between the shadow mask 34 and the screen 32

(measured parallel to the axis A—A) is designated "q." The distance "s" represents the distance from the tube central axis A—A to the center 54 of an off-axis electron beam as it passes through the deflection plane P—P, and "a" represents the center-to-center spacing between apertures in the mask 34. The foregoing dimensions are approximately related as shown in the following equation:

$$q = La/3s$$

The relationship $q = La/3s$ permits proper nesting of phosphor elements on the screen. Nesting is the relationship of phosphor element trios relative to each other wherein the spacing between dots or lines in a trio is the same as the spacing between adjacent dots or lines of different trios.

In the present invention, in order to reduce the effects of doming, the shadow mask 56 is given greater contour or curvature than found in prior art tubes of similar construction. At the same time, the value of "a" is also varied relative to the change or variation in "q" from the prior art. This is a deviation from prior art line screen cathode-ray tubes wherein "a" was made uniform over the entire mask and only "q" was permitted to vary to maintain the preceding equation.

FIGS. 8, 8A, 8B and 8C present a prior art shadow mask having a radius of curvature of 1000 mm. Values for "a" and slit width for this mask are given in millimeters. In the center 60, edge 62 and halfway 64 between the center and edge, the value of "a" is shown to be a constant 0.77 mm. The slit width is graded in decreasing size from the center 60 to the edge 62 of the mask 34.

In an embodiment of the present invention wherein the radius of curvature of a shadow mask 50 is 850 mm., shown in FIGS. 9, 9A, 9B and 9C, the aperture spacing in the mask 56 having greater curvature increases from 0.77 mm. at the center 66 of the mask, to 0.885 mm. at the halfway point 68, to 1.000 mm. at the edge 70 of the mask. If the same slit widths as used in the prior art mask 34 of FIG. 8 were used in the mask 56 of FIG. 9, the transmission of the mask would be reduced beyond a desired level. Therefore, to maintain the desired mask transmission, the slit width is increased relative to the slit width of the prior art mask. In fact, if the values for "a" were varied from 0.77 mm. at the mask center to 1.14 mm. at the edge of the mask, the slit width could be held at a constant 0.15 mm. over the entire mask for a given grading factor. An increase in slit width is highly desirable since it eases manufacturing of the mask.

Table A presents the ratios of mask to screen spacings (q measured parallel to central axis of tube) for two prior art tubes and for two tubes constructed in accordance with the present invention. The first column shows the ratio of q spacing at an edge of a mask along its major axis to the q spacing at the center of the mask. The second column shows the same ratio taken along tube diagonal.

TABLE A

| | Major axis edge q / Center q | Diagonal edge q / Center q |
|---|---|---|
| 19V–90° Prior Art Tube | 1.13 | 1.12 |
| 25V–110° Prior Art Tube | 1.10 | 1.09 |
| 25V Tube 1 incorporating Present Invention | 1.47 | 1.45 |
| 25V Tube 2 incorporating Present Invention | 1.58 | 1.48 |

It can be seen that the edge-to-center q spacing ratios are substantially larger than the same ratios in the prior art tubes. For the two examples of tubes incorporating the present invention, it can be seen that all edge-to-center q spacing ratios are greater than 1.15, preferably being about 1.5. Of course, there is a limit to the amount of curvature that can be given to a mask. This limit is generally determined by what is the greatest degree of coarseness that is acceptable in formation of the phosphor elements of the screen. Such upper limit of edge-to-center q spacing exists at about a ratio of 3.0.

By increasing the curvature of the shadow mask from a radius of 1000 mm. to a radius of 850 mm. both doming and blister warpage as well as their associated resultant misregisters are reduced. Also, it is known that added curvature can provide added strength. Therefore, mask warpage can be reduced. Furthermore, because of the geometric relationships when the tube is operated and the mask becomes heated, a point on a mask having greater curvature moves a smaller distance toward the screen than does a similarly located point on a mask having lesser curvature for a given mask expansion. For the foregoing mask curvatures, doming, or movement of a portion of the mask toward the screen, is reduced from about 48 microns in the 1000 mm. radius of curvature mask to approximately 30 microns in the 850 mm. mask. The increase in "a" permits increases in the misregister tolerances of the off-center phosphor lines. Again, as previously mentioned, the spacing between lines on the screen cannot be too large since it would produce an objectionable coarseness to the viewer. Therefore, the chosen spacing should be a compromise between the possible increase in tolerance and an acceptable coarseness of line trios. By maintaining a smaller value of "a" at the central portions of the screen and allowing the large "a" near the edge regions, the subjective appearance of the screen is that of a fine array.

Table B presents clipping tolerance and doming misregister measurements for a prior art tube and for a new tube with a shadow mask having greater curvature than the mask of the prior art tube (850 mm. vs. 1000 mm. radius) at points halfway between the centers and edges of the tubes. All units are in millimeters.

TABLE B

| | Tolerance Available | Doming Misregister | Result |
|---|---|---|---|
| Prior Art Tube | .053 | .079 | −.026 |
| New Tube | .067 | .066 | .001 |

The increase in clipping tolerances available in the new tube is caused by the larger "a" spacing and the reduction in doming misregister is due to the increased shadow mask curvature of the new tube. Therefore, by increasing mask curvature and "a" spacing, the resultant misregister at the point on the screen where the effects of doming are greatest can be significantly reduced (e.g., by 0.027 mm. in TABLE B).

Figure 10:
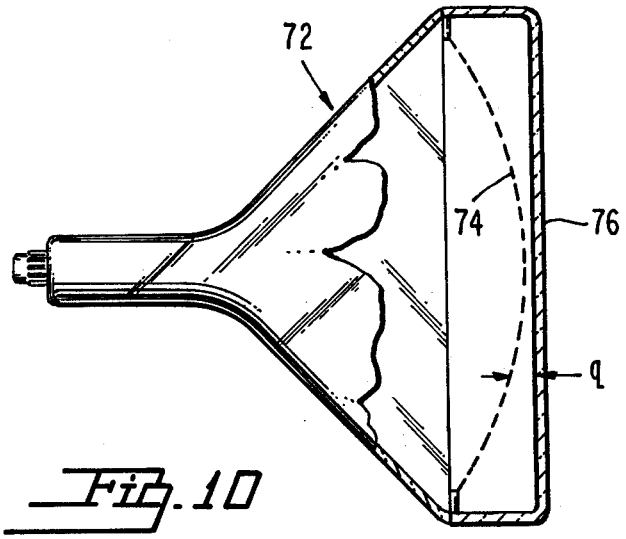
FIG. 10 is a plan view, partly in axial section, of a shadow mask cathode-ray tube having a flat faceplate.

Although the mask having increased curvature and varied "a" spacing has been shown with respect to a curved faceplate, the concept of the present invention also permits use with a flat faceplate. Heretofore, although shadow masks for use with line screens have not had exactly the same curvature as their associated faceplates, it can be said that the mask and faceplates were substantially parallel. A flat faceplate is desirable since it permits greater viewing angle without distortion of a portion of the picture. FIG. 10 shows a cathode-ray tube 72 having a curved shadow mask 74 but a flat faceplate 76. The "q" spacing in this tube increases substantially from the center to the edge of the mask and the "a" spacing of the mask apertures similarly increases to maintain acceptable nesting of the phosphor lines on the screen.

Figure 11:
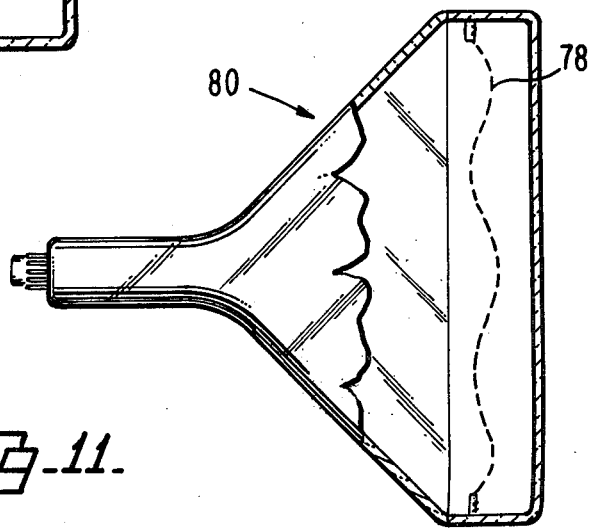
FIG. 11 is a plan view, partly in axial section, of another shadow mask cathode-ray tube having a flat faceplate.

It should be appreciated that the concept of increasing mask curvature over that found in prior art tubes to strengthen the mask and reduce doming is not necessarily limited to masks of spherical or substantially spherical shape. As shown in FIG. 11, the curvature of a mask 78 in a flat-face cathode-ray tube 80 may also have a reverse curve to give greater strength to the mask. In this case, the "q" spacing increases then decreases from center to edge of the mask. The "a" value then is varied in relation to the variation in "q" spacing, therefore, it too increases then decreases from center to edge of the mask.

The preceding embodiments of the present invention incorporate the combination of increased curvature to the mask relative to the curvature suggested by the prior art and variable "a" spacing as one proceeds outwardly from the center of the tube. In some conventional prior art tubes, the mask to screen spacing "q" is greater at the edge of the mask than at the center. When the present invention is applied to such a tube the mask to screen spacing is given even greater variation. However, it will be appreciated that the invention is equally applicable to a prior art tube design in which the edge "q" may be smaller than the center "q." In this case, application of the invention to such a design would result in varying the "q" spacing from what it would be in an otherwise identical prior art tube. Such a variation however, may not actually result in a tube having a larger edge "q" than center "q" but instead could result in a tube having a smaller edge "q" than center "q" albeit not as small as it was, or perhaps in a tube having a constant "q." Thus, the invention should not be equated with the relative size of edge versus center "q" in a tube, but rather to the relative size and variation of the "q" to that of an otherwise identical prior art tube. The same relationship applies to a conceptual statement of the "a" dimension since this dimension is varied with respect to variations in "q" from that suggested by the prior art.

The broad scope of the present inventive concept also permits further development of cathode-ray tubes having flat faceplates. Hereinafter, some of the problems involved in the construction of tubes having flat faceplates are discussed and embodiments incorporating the present invention to solve these problems are presented.

Figure 13:
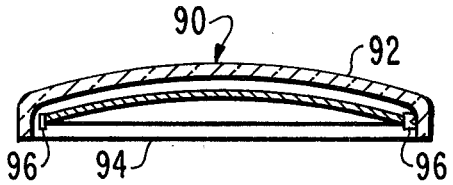
FIGS. 13 and 14 are axial section views taken, respectively, at lines 13—13 and 14—14 in FIG. 12.
Figure 12:
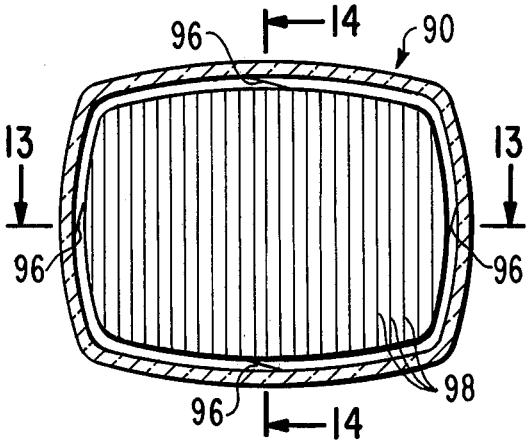
FIG. 12 is a rear view of a tube faceplate having a prior art shadow mask mounted therein with lines thereon indicating centerlines of aperture columns.
Figure 14:
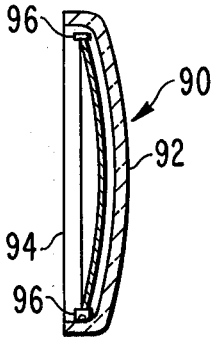

FIGS. 12, 13 and 14 illustrate a prior art panel assembly 90 comprising a faceplate panel 12 having a spherically curved faceplate and a curved shadow mask 94 removably mounted on spring supports 96 to the sidewall of the panel. The mask 94 has slit shaped apertures (not shown) that are distributed in vertical columns. The centerlines of the apertured columns are shown in FIG. 12 as lines 98. Because of various geometric factors involving foreshortening of the inline electron beam triad when scanned to the left and right portions of the screen, the curvature of the mask 94 along the horizontal axis (shown in FIG. 13) is slightly different than the mask curvature along the vertical axis (shown in FIG. 14).

Figure 16:
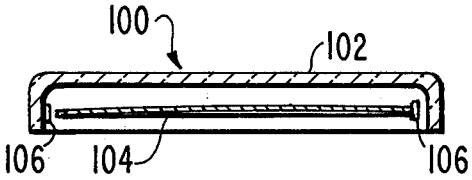
FIGS. 16 and 17 are axial section views taken, respectively, at lines 16—16 and 17—17 in FIG. 15.
Figure 15:
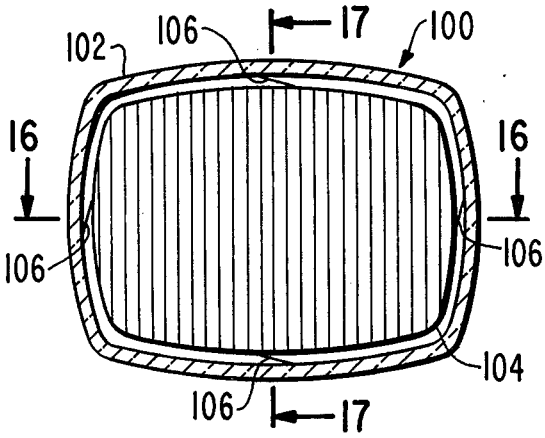
FIG. 15 is a rear view of a flat tube faceplate having a shadow mask mounted therein that is suggested by the prior art.
Figure 17:
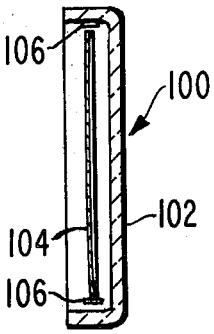

FIGS. 15, 16 and 17 show a panel assembly 100 wherein the teaching of the prior art is applied to a flat faceplate embodiment. The assembly comprises a flat faceplate panel 102 and a contoured apertured shadow mask 104 removably mounted therein on four spring supports 106. As stated with respect to the prior art assembly 90, the curvature of the mask is different along the horizontal and vertical axis. Because of this difference in curvature, the mask 104, constructed in accordance with the prior art concept of holding the "a" dimension constant, is slightly convex facing the faceplate 102 along the horizontal axis (shown in FIG. 16) and is slightly concave along the vertical axis (shown in FIG. 17). Probably the major disadvantage of the mask 104 is that it has very little curvature to overcome the previously discussed problems of mask doming. Therefore, it is desirable to provide a mask with sufficient curvature to substantially reduce the effects of doming which still permits formation of an acceptable viewing screen. The concept of permitting the "a" dimension to vary with variations in "q" from the prior art provides just such result.

Figure 19:
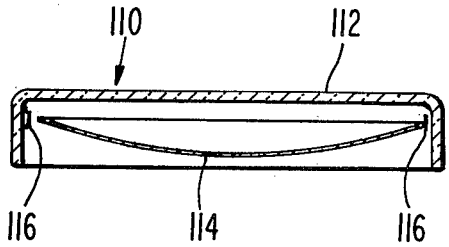
FIGS. 19 and 20 are axial section views taken, respectively, at lines 19—19 and 20—20 in FIG. 18.
Figure 18:
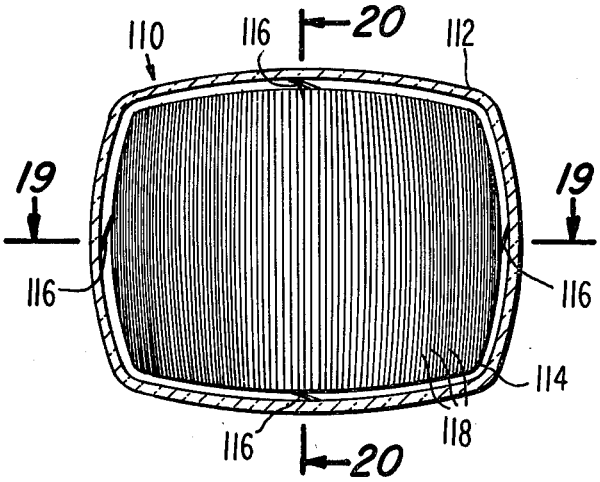
FIG. 18 is a rear view of a tube faceplate incorporating an embodiment of the present invention having a shadow mask mounted therein with lines thereon indicating centerlines of aperture columns.
Figure 20:
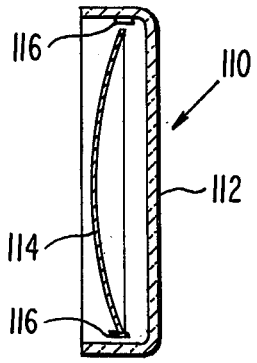

FIGS. 18, 19 and 20 show a panel assembly 10 comprising a flat faceplate panel 112 and curved shadow mask 114 removably mounted to the faceplate panel 112 by spring supports 116 with the concave side of the mask 114 facing the faceplate panel 112. The curvature of the mask 114 is substantially greater than the curvature of the mask 104 of FIG. 15 thus providing greater rigidity and less doming misregister than that mask. Since the concave portion of the mask 114 faces the flat faceplate panel 112, the "q" spacing is the greatest at the center of the mask and a minimum at the periphery of the mask. The same aforementioned approximate equation $q = La/3s$ is applied to this flat faceplate embodiment. The horizontal "a" spacing between aperture centerlines 118 is made to vary with "q" spacing in both the horizontal and vertical directions from the center of the mask. As shown in FIG. 18, this spacing results in a barrel-shape configuration of aperture centerlines 118 as well as an increasing closeness of adjacent aperture centerlines at locations toward the edge of the screen.

Figure 22:
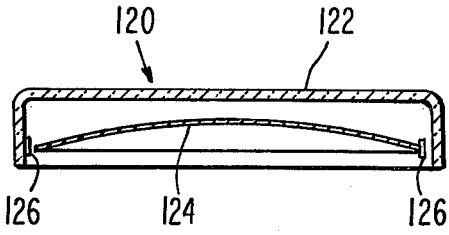
FIGS. 22 and 23 are axial section views taken, respectively, at lines 22—22 and 23—23 in FIG. 21.
Figure 21:
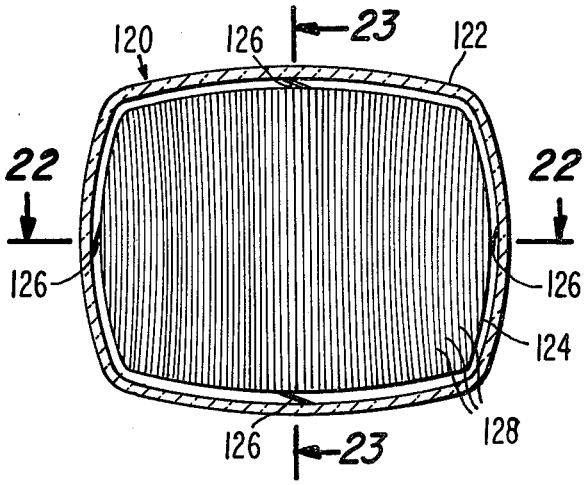
FIG. 21 is a rear view of a flat tube faceplate incorporating another embodiment of the present invention therein with lines thereon indicating centerlines of aperture columns.
Figure 23:
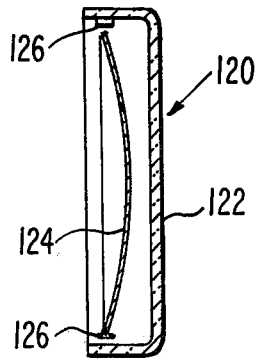

In another flat panel assembly 120, shown in FIGS. 21, 22, and 23, having a flat faceplate panel 122, a curved shadow mask 124 is removably mounted to the faceplate panel 122 by spring supports 126 so that its convex side faces the faceplate. This embodiment is the reverse of the one just previously described in that the "q" spacing is a minimum at the center of the mask 124 and greatest at the periphery of the mask. In this particular assembly, the "a" spacing along the central horizontal axis the mask is held constant even though "q" spacing varies along the horizontal axis. Off from the horizontal axis, the "a" spacing is made to vary in relation to the variation in "q" spacing from the embodiment suggested by the prior art shown in FIG. 15. This embodiment of holding the "a" spacing constant on the horizontal axis, can be achieved by keeping the same curvature at the horizontal axis as in the embodiment of FIG. 15 but reversing the curvature along the vertical axis. The resultant configuration of aperture columns 128 is pincushioned, as shown in FIG. 21. Of course, the mask can be given greater curvature along the horizontal axis and the "a" spacing varied accordingly to produce a relative compression of aperture centerlines toward the center of the screen.

A mask-panel assembly 130, similar to that incorporated by the tube 80 of FIG. 11, is depicted in FIG. 24. A mask 132 in assembly 130 is corrugated or somewhat sinusoidally curved along the horizontal axis (in the direction of the longer dimension of the mask) with the corrugations being parallel to each other and extending vertically (between long sides of the mask or in the direction of the shorter dimension of the mask). The term corrugated is herein defined broadly to include various cross-sectional shapes including a sawtooth waveform as well as sinusoidal cross-sectional shapes. Although the mask 132 is shown without any curvature vertically, masks having some curvature along the vertical axis also are included within the scope of the present invention, an example of which will be presented later.

The mask 132 includes a plurality of slit-shaped apertures 134 aligned in vertical columns. In order to keep acceptable line formation on the screen, the horizontal spacing "a" between apertures is varied as a function of the spacing between the mask 134 and the assembly faceplate panel 136 taking into account variations from the idealized mask shape of FIG. 15. Generally, to obtain sufficient strength the peak-to-peak wavelength dimension of the corrugated or sinusoidal variation in the mask should be at least twice as great as the spacing between adjacent apertures.

As shown in FIG. 24, the apertured mask 132 is mounted to the faceplate panel 136 by a plurality of flexible supports 138 positioned along the long sides of the mask 132 and rigid supports 140 positioned at the short sides of the mask 132. Each of the flexible supports 138 is L-shaped, comprising two flanges 142 and 144, and is attached to the faceplate panel 136 at the bottom flange 142 by suitable means such as by being sealed with a glass frit. The second flange 144 of each flexible support 138 is cantilevered out from the faceplate panel 136 and provides the flexible portion of the support 138. The mask 132 is connected to the flexible supports 138 at points of inflection where the direction of curvature of the mask changes. Such points are on the centerline or zero axis of the corrugated or sine-wave mask cross-sectional shape. The cantilever structure of the supports 138 permits flexibility in the vertical direction (as determined by the tube in its operating orientation) thus allowing for thermal expansion of the mask in this direction. In the horizontal direction, however, the supports 138 are very rigid. Correspondingly, the supports 140 on the short sides of the mask 132 are rigid in both the horizontal and vertical directions and hold the center of the mask from movement.

Although the corrugated masks have been described with respect to a flat faceplate, such may also be used with curved faceplates. FIGS. 25, 26 and 27 depict a faceplate panel assembly 146 having a rectangular faceplate 148 that is cylindrically curved and to which an apertured mask 150 is mounted by means of flexible and rigid supports, 152 and 154, respectively. The mask 150 is corrugated with the points of inflection of the corrugations lying in a curved or cylindrical plane. Although not shown, the horizontal aperture-to-aperture centerline spacing is varied relative to such spacing in a prior art cylindrical faceplate tube by an amount which is a function of the variation in mask-faceplate spacing between present corrugated mask tube and a prior art cylindrical mask tube. The flexible supports 152 extend from the faceplate 148 and are attached to the long sides of the mask 150 at points of inflection. The rigid supports 154 also extend from the faceplate 148 and are attached to the mask 150 at the center of its short sides.

Figure 29:
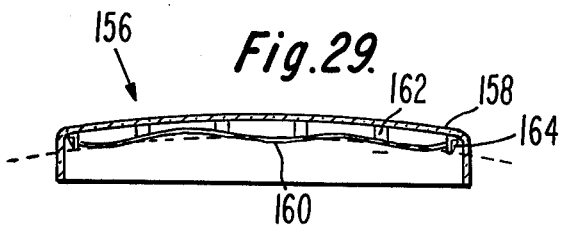
FIGS. 29 and 30 are axial section views taken, respectively, at lines 29—29 and 30—30 in FIG. 28.
Figure 28:
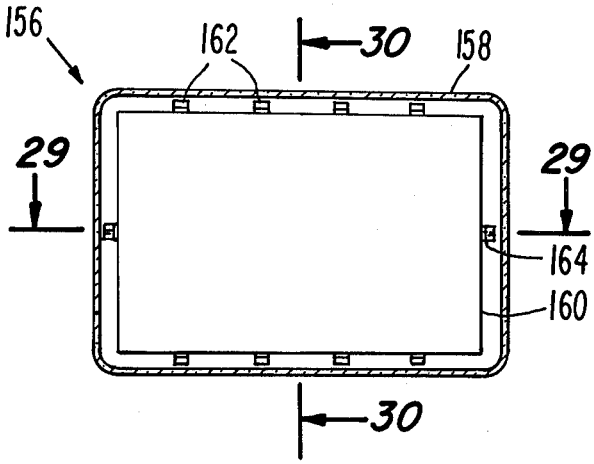
FIG. 28 is a rear view of a cathode-ray tube mask-faceplate assembly having a substantially spherical faceplate and a substantially spherically-shaped corrugated mask.
Figure 30:
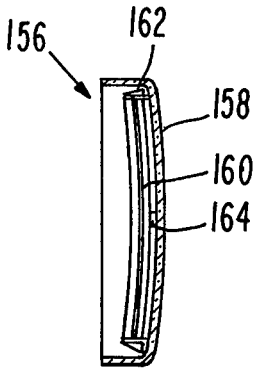

In another embodiment, illustrated in FIGS. 28, 29 and 30, a faceplate panel assembly 156 is shown with a spherically curved faceplate 158. A mask 160 is attached to the faceplate 158 by means of flexible and rigid supports 162 and 164, respectively. The mask 160 is spherically curved similar to the faceplate 158 and has vertically extending parallel corrugations superimposed thereon. Like the previous embodiment, the horizontal aperture to aperture centerline spacing varies in relation to the variation in mask to faceplate spacing from that suggested by the prior art. The flexible supports 162 extend from the faceplate 158 and are attached to the points of inflection along the long sides of the mask 160 and the rigid supports 164 are attached to the centers of the short sides of the mask.

I claim:

1. In a cathode-ray tube of the vertical line screen, slit apertured mask type, the improvement comprising, the ratio of mask-to-screen spacing at the edge of the screen on the horizontal central axis to the mask-to-screen spacing at the center of the screen being in the range of 1.15 to 3.0.

2. The tube as defined in claim 1, including the horizontal spacing between apertures in the mask changing as a function of the change of the mask-to-screen spacing.

3. In a cathode-ray tube comprising an evacuated envelope including a faceplate, a color phosphor line screen including a plurality of arrays of substantially parallel vertical phosphor lines affixed to an inner surface of said faceplate, the phosphor lines in each array being adapted to emit light of a particular color, an apertured mask spaced from said screen, said apertured mask having a plurality of substantially parallel vertical columns of apertures elongated in the direction of said columns, and means for generating and directing a plurality of electron beams through the apertures of said mask to said screen, the improvement comprising, the spacing between the centerlines of adjacent columns of apertures and the spacing between the apertured mask and said screen both varying in relation to each other and increasing from center to edge of said mask along the horizontal axis thereof.

4. The cathode-ray tube as defined in claim 3, wherein the width of the mask apertures are substantially constant over said mask.

5. The cathode-ray tube as defined in claim 3, wherein the width of the mask apertures are greater at the edges of said mask at the ends of the horizontal axis than in the center of said mask.

6. The cathode-ray tube as defined in claim 3, wherein the ratio of mask-screen spacing at the edges of said mask at the ends of the horizontal axis to the mask-screen spacing at the center of the mask is in the range of 1.15 to 3.0.

7. The cathode-ray tube as defined in claim 6, wherein said ratio is approximately 1.5.

8. The cathode-ray tube as defined in claim 3, wherein the horizontal edge-to-edge spacing between apertures is varied over said mask to provide visually acceptable packing of the phosphor lines.

9. The cathode-ray tube as defined in claim 3, wherein said faceplate is substantially flat and said mask is curved.

10. The cathode-ray tube as defined in claim 9, wherein the rate of change of spacing between said mask and said screen changes at least once from the center of said mask to the outer edges of said mask at the ends of the horizontal axis.

11. In a cathode-ray tube with a substantially flat faceplate utilizing an apertured mask color selection technique for registering a plurality of inline electron beams on phosphor elements of a cathodoluminescent line screen, said tube having structural relationships which approximately satisfy the formula $q = La/3s$ in which "q" is the spacing between the mask and the cathodoluminescent screen of said tube, "L" is the spacing between a plane of deflection of said tube and said screen, "a" is the center-to-center spacing of adjacent mask apertures, and "s" is the spacing between an off axis electron beam path and the central tube axis in the plane of deflection, the improvement comprising, said apertured mask being curved and having a convex side facing said faceplate wherein the "q" spacing is a minimum at the center of said mask and is greatest at the periphery of said mask and, the horizontal "a" spacing is constant along the central horizontal axis of said mask and increases in relation to the increase in the "q" spacing above and below the central horizontal axis.

12. In a cathode ray tube of the line screen-inline gun type, the improvement comprising, the spacing between an apertured mask of said tube and a screen of said tube being approximately 1.5 times greater at an off-center point on the screen than at the center of the screen.

* * * * *